US005645120A

United States Patent [19]

Tsuyuguchi et al.

[11] Patent Number: 5,645,120

[45] Date of Patent: Jul. 8, 1997

[54] JOINT STRUCTURE FOR CASTING NOZZLE

[75] Inventors: Koji Tsuyuguchi, Düsseldorf, Germany; Haruyoshi Kimura; Hideaki Kawabe, both of Fukuoka-ken, Japan; Eizaburo Arimitsu, Guipuzcoa, Spain

[73] Assignee: Krosaki Corporation, Fukuoka-ken, Japan

[21] Appl. No.: 493,513

[22] Filed: Jun. 22, 1995

Related U.S. Application Data

[63] Continuation of Ser. No. 114,118, Aug. 30, 1993, abandoned.

[30] Foreign Application Priority Data

Sep. 2, 1992 [JP] Japan ..... 4-234950

[51] Int. Cl.[6] ..... B22D 11/00; B22D 41/50

[52] U.S. Cl. ..... 164/437; 164/337; 222/591; 222/594

[58] Field of Search ..... 164/437, 337; 222/591, 594

[56] References Cited

U.S. PATENT DOCUMENTS

| | | | |
|---|---|---|---|
| 3,730,401 | 5/1973 | Bode, Jr. | 164/437 |
| 3,907,022 | 9/1975 | Simons et al. | 164/437 |
| 5,184,665 | 2/1993 | Boudot | 164/337 |

FOREIGN PATENT DOCUMENTS

| | | | |
|---|---|---|---|
| 0102292 | 3/1984 | European Pat. Off. | 164/437 |
| 0292925 | 11/1988 | European Pat. Off. | 164/437 |
| 2439944 | 4/1975 | Germany | 164/437 |
| 59-223149 | 12/1984 | Japan | 164/437 |
| 62-50070 | 3/1987 | Japan | 164/437 |

*Primary Examiner*—Joseph J. Hail, III
*Assistant Examiner*—L.-H. Lin
*Attorney, Agent, or Firm*—Jordan and Hamburg

[57] ABSTRACT

A casting nozzle joint structure capable of easily positioning and jointing a nozzle without any holder for fixing and supporting a continuous casting nozzle therethrough. The joint structure comprises fitting mechanism formed in and on the mating faces of the continuous casting nozzle and the pressure clamper. The fitting mechanism includes a convex portion and a concave portion formed in and on the mating faces of the continuous casting nozzle and the pressure clamper so that they fit one another. The concave or convex portion formed in the mating face of the continuous casting nozzle is fitted on or in the convex or concave portion formed in the mating face of the pressure clamper, and this pressure clamper clamps the fitted engagement. Thus, the nozzles can have their outlet bores positioned, and the submerged entry shroud can have its discharge port oriented.

11 Claims, 4 Drawing Sheets

JOINT STRUCTURE FOR CASTING NOZZLE

This application is a continuation of application Ser. No. 08/114,118 filed Aug. 30, 1993 and now abandoned.

BACKGROUND OF THE INVENTION

1. Field of the Invention:

The present invention relates to a joint structure for jointing between a pressure clamper and a casting nozzle to the lower portion of a casting nozzle which is attached to a ladle or tundish of a continuous steel casting apparatus.

2. Description of the Prior Art

The continuous steel casting apparatus is equipped with a portion, at which two nozzles, such as a ladle lower nozzle and a ladle shroud, or a tundish lower nozzle and a submerged entry shroud, have to be jointed to each other.

This joint will be described in the prior art by using the joint between a submerged entry shroud and a slide gate as an example.

As shown in FIG. 12 and FIG. 13, presenting a top plan section taken along line XIII—XIII of FIG. 12, there is currently adopted a structure in which a submerged entry shroud "a" mounted by a hanger-like pressure clamper "f" on a holder "e" through mortar "d" is pressed onto a bottom of a casting nozzle "c" fixed on the bottom of a slide gate "b".

However, this joint structure of the prior art is defective in that it is deformed in the holder by heat, which is transferred from the molten steel flowing through the nozzles, and so requires periodic replacements. Another defect is that the mortar used for fixing the nozzles deteriorates the working efficiency so that it takes a long time to set and joint the nozzles. Still another defect is that the submerged entry shroud requires its discharge port to be oriented in a predetermined direction, thus making it difficult to position the nozzles relative to each other.

SUMMARY OF THE INVENTION

An object of the present invention relates to a casting nozzle joint structure capable of easily positioning and jointing a nozzle without any holder while eliminating the defects of the prior art.

According to an aspect of the present invention, there is provided a joint structure comprising a pressure clamper for fixing and supporting a continuous casting nozzle therethrough, wherein the improvement comprises a fitting means formed in and on the mating faces of said continuous casting nozzle and said pressure clamper. The fitting means may include a convex portion and a concave portion formed in and on the mating faces of the continuous casting nozzle and the pressure clamper so that they fit one another. The fitting means can be exemplified by any arbitrary type of toggle, cotter and bayonet mechanisms known in the prior art.

According to another aspect of the present invention, the fitting means can be provided in a desired number, as necessary.

According to a further aspect of the present invention, the joint structure can comprise a disengagement preventing means for preventing the fitted faces of the continuous casting nozzle and the pressure clamper from coming apart.

According to a yet further aspect of the present invention, the joint structure can comprise a reinforcing structure including a reinforcing metal plate sandwiched between the mating faces of the continuous casting nozzle and the pressure clamper for reinforcing the fitted portions by receiving the locally concentrated pressure.

The concave or convex portion formed in the mating face of the continuous casting nozzle is fitted on or in the convex or concave portion formed in the mating face of the pressure clamper, and this pressure clamper clamps the fitted engagement. As a result, the nozzles can have their outlet bore positioned and, still the better, the submerged entry shroud can have its discharge port oriented.

BRIEF DESCRIPTION OF THE INVENTION

DESCRIPTION OF THE PREFERRED EMBODIMENTS

Figure 12:
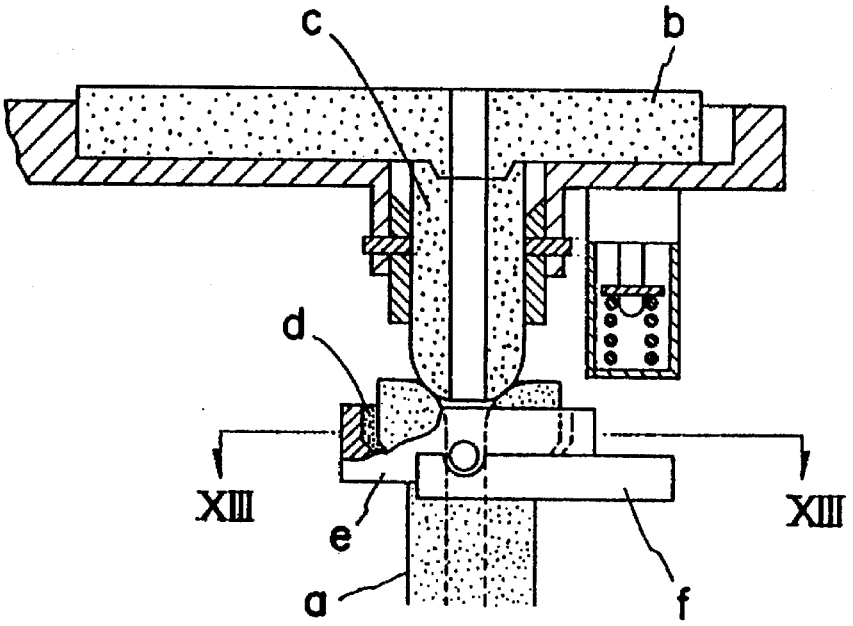
FIG. 12 shows a joint structure between the submerged entry shroud and the sliding nozzle according to the prior art.
Figure 13:
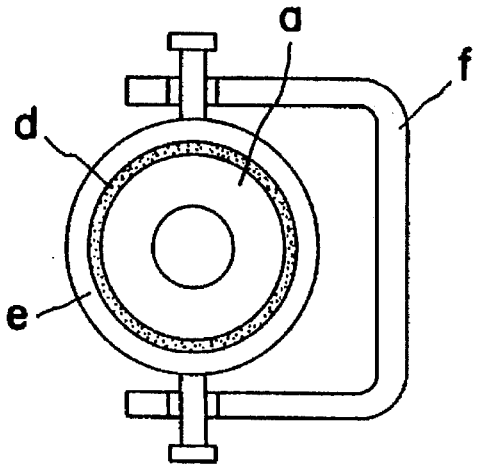
FIG. 13 is a top plan section taken along line XIII—XIII of FIG. 12.

The embodiments to be described are exemplified by applying the fitting means to a joint between the submerged entry shroud and the slide gate, as shown in FIG. 12. Illustrations will be made to emphasize the relation between the submerged entry shroud 1 and the pressure clamper (or hanger) 4.

Figure 1:
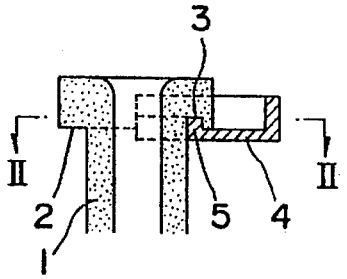
FIG. 1 is a vertical section showing a first embodiment of the present invention.
Figure 2:
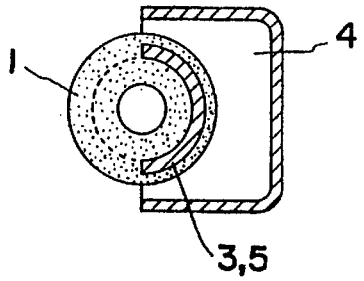
FIG. 2 is a top plan section taken along line II—II FIG. 1.

Embodiment 1:

FIG. 1 shows a first embodiment, and FIG. 2 is a top plan section taken along line II—II.

As shown in these Figures, the submerged entry shroud 1 has its support face 2 formed with a semicircular recess 3, and the pressure clamper 4 of hanger type, for example, is formed with a ridge 5 which is sized and positioned to correspond to the recess 3 of the casting nozzle. Thus, the ridge 5 is press-fitted in the recess 3 by the pressure clamper 4.

Figure 3:
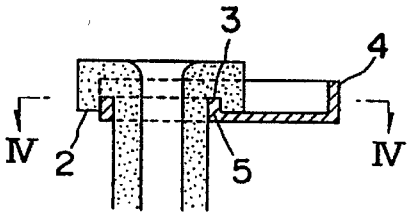
FIG. 3 is a vertical section showing a second embodiment of the present invention.
Figure 4:
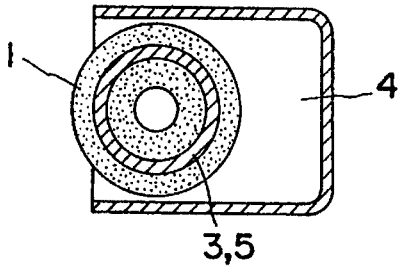
FIG. 4 is a top plan section taken along line IV—IV FIG. 3.

Embodiment 2:

FIG. 3 shows a second embodiment, and FIG. 4 is a top plan section taken along line IV—IV.

In this embodiment, the recess 3 formed in the submerged entry shroud 1 is circular so as to extend around the root of the support face 2 of the submerged entry shroud 1, and a ridge 5 is also formed in the hanger type pressure clamper 4 so that it is sized and positioned to correspond to the recess 3.

Figure 5:
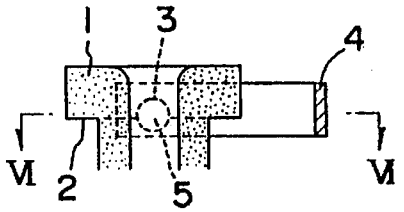
FIG. 5 is a vertical section showing a third embodiment of the present invention.
Figure 6:
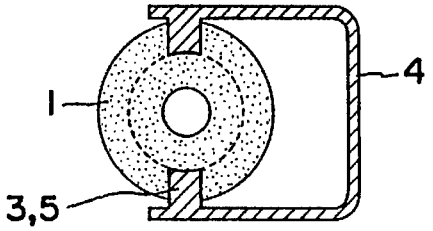
FIG. 6 is a top plan section taken along line VI—VI FIG. 5.

Embodiment 3:

FIG. 5 shows a third embodiment, and FIG. 6 is a top plan section taken along line VI—VI.

In this embodiment, the support face 2 of the submerged entry shroud 1 is formed on the center of its base with straight recesses 3 which are to fit the ridges 5 of the pressure clamper 4. This structure is additionally given a function to prevent the fitting from faltering between the nozzle 1 and the pressure clamper 4, the faltering being caused by the deformation coming from a thermal load carried over a long period. This structure provides the straight fitting means with another advantage in that it can be set relatively simply.

Figure 7:
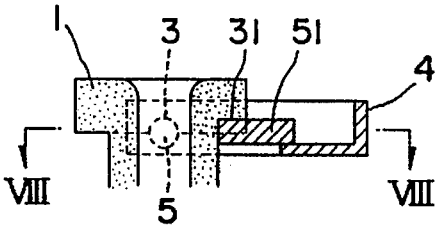
FIG. 7 is a vertical section showing a fourth embodiment of the present invention.
Figure 8:
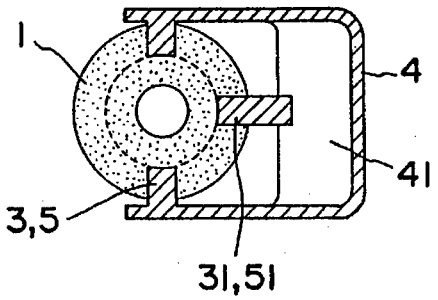
FIG. 8 is a top plan section taken along line of VIII—VIII FIG. 7.

Embodiment 4:

FIG. 7 shows a fourth embodiment, and FIG. 8 is a top plan section taken along line VIII—VIII.

In this embodiment, another straight recess 31 is formed at a right angle with respect to the straight recesses 3 formed on the center of the base of the support face 2 in the embodiment 3 shown in FIGS. 5 and 6. The pressure clamper 4 is also formed with a corresponding ridge 51 at a right angle with respect to the ridges 5, and the pressure clamper 4 is reinforced by a reinforcing bottom plate 41 extending therefrom.

As a result, the fitting joint between the submerged entry shroud 1 and the pressure clamper 4 is strengthened when pressed by the clamper 4, so that the connection to the tundish nozzle, as shown in FIG. 12, can be better ensured.

Figure 9:
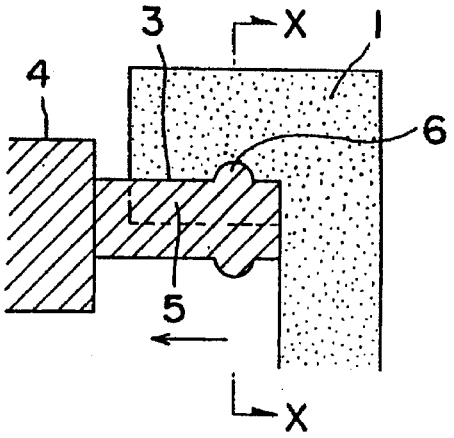
FIG. 9 shows a disengagement prevention mechanism disposed at the side of the pressure clamper.
Figure 10:
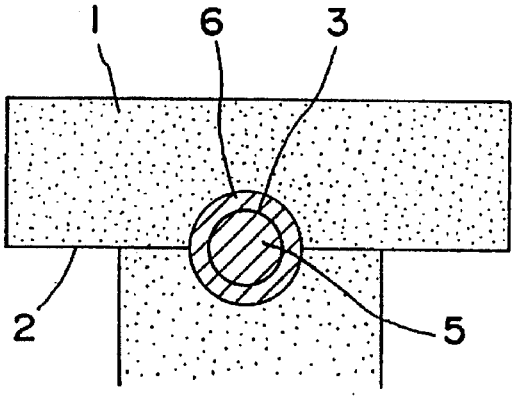
FIG. 10 is a vertical section taken along line X—X of FIG. 9.

Embodiment 5:

In FIG. 9 and FIG. 10, presenting the longitudinal section taken along line X—X, there is shown the fifth embodiment, in which the support face 2 of the submerged entry shroud 1 is formed therein with a recess at a right angle with respect to the recess or recesses 3 of the foregoing individual embodiments, whereas the pressure clamper 4 is formed with a ridge at a right angle with respect to the ridge or ridges 5 to be fitted in the recess or recesses 3, thus constituting a disengagement prevention mechanism 6. Thanks to this mechanism 6, the ridge 5 of the pressure clamper 4 is prevented from moving in the direction indicated by the arrow out of engagement with the recess 3 formed in the support face 2 of the submerged entry shroud 1.

Figure 11:
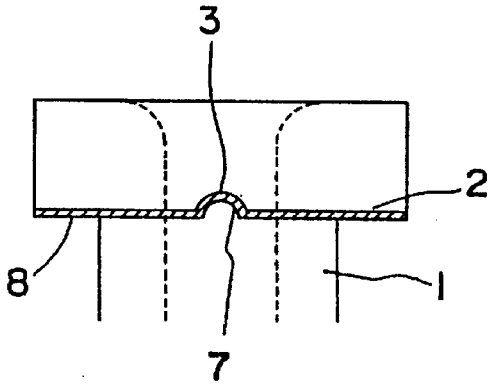
FIG. 11 shows a reinforcing structure for a fitting recess of a submerged entry shroud.

Embodiment 6:

FIG. 11 shows a reinforcing structure for receiving the pressure to be concentrated in the recess 3, which is formed in the support face 2 of the submerged entry shroud shown in the foregoing individual embodiments, when the projection of the pressure clamper is fitted in the recess 3, thereby preventing the recess 3 from being broken.

As shown in the same Figure, the reinforcing structure includes a reinforcing metal plate 8 which is formed with a recess 7 corresponding to the recess 3 formed in the support face 2 of the submerged entry shroud 1. This metal plate is arranged on the support face 2 of the submerged entry shroud 1 for reinforcing the fitted portions by receiving the locally concentrated pressure. In a modification, this metal plate 8 may be shaped into a casing shape covering the supporting face 2 of the submerged entry shroud 1.

The joint structures thus embodied above were adopted for connecting the ladle lower nozzle of 300 tons, and the submerged entry shroud, and were subjected to casting operations of eight charges for 400 minutes. It was confirmed that the joint experienced no such deterioration as to cause either the invasion of air or leakage of molten steel.

According to the casting nozzle joint structure of the present invention, neither mortar nor any holder need be used for ensuring the reliable positioning and connection when a nozzle is to be attached to the ladle or tundish of an ordinary casting nozzle or a continuous casting nozzle such as the ladle shroud or the submerged entry shroud.

What is claimed is:

1. A casting nozzle joint structure comprising a casting nozzle, a supported nozzle, said supported nozzle comprising an elongated nozzle body and a nozzle flange which is integral with said nozzle body, said nozzle flange having an outer diameter greater than the outer diameter of said nozzle body, a rigid U-shaped pressure clamper structure for supporting said supported nozzle and for moving said supported nozzle between a pressed position in which the supported nozzle is pressed against said casting nozzle and a separated position in which said supported nozzle is separated from said casting nozzle, said supported nozzle having a first mating surface on said nozzle flange, said rigid U-shaped pressure clamper structure having a second mating surface, one of said first and second mating surfaces comprising a concave surface, the other of said first and second mating surfaces comprising a convex surface, said concave surface receiving and directly contacting said convex surface when said supported nozzle is in said pressed position such that said supported nozzle is thereby directly contacted and supported by said pressure clamper structure when said pressure clamper structure is in said pressed position and when said pressure clamper structure is moved between said pressed position and said separated position, a recess indented into said concave surface and a ridge projecting from said convex surface, said recess receiving said ridge when said concave surface receives and directly contacts said convex surface.

2. A casting nozzle joint structure according to claim 1 wherein said recess and ridge have substantially the same cross-sectional configuration.

3. A casting nozzle joint structure according to claim 1 wherein said recess is a semicircular recess.

4. A casting nozzle joint structure comprising a casting nozzle, a supported nozzle, said supported nozzle comprising an elongated nozzle body and a nozzle flange which is homogenous with said nozzle body, said nozzle flange having an outer diameter greater than the outer diameter of said nozzle body, a rigid U-shaped pressure clamper structure for supporting said supported nozzle and for moving said supported nozzle between a pressed position in which the supported nozzle is pressed against said casting nozzle and a separated position in which said supported nozzle is separated from said casting nozzle, said supported nozzle having a first mating surface on said nozzle flange, said first mating surface being homogenous with said nozzle flange, said rigid U-shaped pressure clamper structure having a second mating surface, said second mating surface being homogeneous with said U-shaped pressure clamper, one of said first and second mating surfaces comprising a concave surface, the other of said first and second mating surfaces comprising a convex surface, said concave surface receiving and directly contacting said convex surface when said supported nozzle is in said pressed position such that said supported nozzle is thereby directly contacted and supported by said pressure clamper structure when said pressure clamper structure is in, said pressed position and when said pressure clamper structure is moved between said pressed position and said separated position.

5. A casting nozzle joint structure according to claim 4 wherein said concave surface is on said nozzle flange.

6. A casting nozzle joint structure according to claim 4 wherein said convex surface is on said pressure clamper.

7. A casting nozzle joint structure according to claim 4 wherein said concave portion is a recess having a semi-circular cross section, said recess having a recess axis, said convex portion being a projection having a circular cross section, said projection having a projection axis, said recess receiving said projection with said recess axis aligned with said projection axis.

8. A casting nozzle joint structure according to claim 7 further comprising another recess having a recess axis disposed at a right angle to the recess axis of the first said recess, another projection having a projection axis disposed at a right angle to the projection axis of the first said projection, said other recess receiving said other projection.

9. A casting nozzle joint structure according to claim 4 wherein said first and second mating surfaces underlie said nozzle flange.

10. A casting nozzle joint structure according to claim 4 wherein said nozzle flange has a top surface adapted to mate with said casting nozzle when said supported nozzle is in said pressed position, said nozzle flange having a lower surface, said first mating surface being formed on said lower surface.

11. A casting nozzle joint structure according to claim 10 wherein said top nozzle surface has a concave engaging surface adapted to engage a corresponding convex engaging surface on said casting nozzle.

* * * * *